United States Patent [19]

Shore

[11] 3,949,932

[45] Apr. 13, 1976

[54] END BOX FOR PACKAGING ARTICLES

[75] Inventor: Michael B. Shore, Barrington, R.I.

[73] Assignee: Simon Nemzow, Providence, R.I. ; a part interest

[22] Filed: May 8, 1974

[21] Appl. No.: 467,901

[52] U.S. Cl. ..... 229/40; 206/451; 206/491

[51] Int. Cl.[2] ..... B65D 5/18; B65D 75/02

[58] Field of Search ..... 206/491, 443, 451, 328, 206/419; 229/40

[56] References Cited

UNITED STATES PATENTS

| | | | |
|---|---|---|---|
| 1,929,161 | 10/1933 | Coffin et al. | 206/451 |
| 2,099,783 | 11/1937 | Whiteside | 206/443 X |
| 2,946,165 | 7/1960 | Cote | 206/491 X |
| 3,841,477 | 10/1974 | Stark et al. | 206/491 |

FOREIGN PATENTS OR APPLICATIONS

| | | | |
|---|---|---|---|
| 49,058 | 3/1940 | Netherlands | 206/451 |
| 519,119 | 2/1931 | Germany | 206/443 |

*Primary Examiner*—Leonard Summer
*Attorney, Agent, or Firm*—Salter & Michaelson

[57] ABSTRACT

A box for packaging one or more articles, wherein the end portions of said articles are protected, including opposed face panels that are located in parallel, spaced apart relation for receiving the end portions of said articles therebetween, a one-piece end panel being joined to the face panels and located at right angles with respect thereto for covering the ends of the articles, and a flexible tie member wrapped transversely around said face panels for securing said box in secure position on said articles.

1 Claim, 4 Drawing Figures

END BOX FOR PACKAGING ARTICLES

BACKGROUND OF THE INVENTION

The present invention relates to a box for packaging one or more articles for shipping or storing, wherein only end portions of the articles are received in the box.

In the ordinary practice of packaging articles for shipping or storing, it is essential to protect the surfaces thereof; and prior to the instant invention, conventional full length box constructions have been employed for this purpose. Such conventional boxes known heretofore extended the full length of the articles that were received therein and included end panels that completely sealed the articles within the box construction. Although the conventional box for packaging such articles served the purpose of protecting the articles during the shipping or storing thereof, the cost of such boxes was relatively high because of the size thereof. Further, cardboard containers have been in short supply, and the use of the conventional box in regard to the cost thereof has become almost prohibitive. In packaging a plurality of articles in the conventional box, usually more than one person was required because of the handling difficulties; and this also increased the overall cost of packaging by the prior known manner.

SUMMARY OF THE INVENTION

The present invention relates to an end box for packaging one or more articles and includes a one-piece blank that is foldable to a position of use around only the end portions of the articles to be packaged. The one-piece blank includes opposed, parallel face panels that overlie end portions of the articles and further includes an end panel that is joined to the face panels and that is located at right angles with respect thereto in the folded position thereof. The end panel covers the outermost edges of the articles and cooperates with the face panels and flaps joined thereto to protect the end portions of the articles during shipping or storing. In order to secure the end box on the end portions of the articles, the preferred form of the invention includes slots that are formed in the face panels intermediate the ends thereof for exposing the underlying surfaces of said articles. A flexible tie member is secured around the face panels and is received in the slots for engaging the underlying surfaces of said articles for securing the end box on said articles adjacent to an end thereof. If the articles to be pakcaged are elongated, both ends of the articles would receive an end box thereon so that the intermediate portions of the articles would be exposed. However, the thickness of the material from which the end boxes are formed serves to space the exposed portions of the articles when the articles as packaged are located in stacked relation for shipping or storing. This spacing thereby prevents the exposed portions of the articles from being scratched or marred.

Accordingly, it is an object of the invention to provide an end box for packaging articles therein that includes a one-piece construction that is foldable from blank form to a position of use around only the end portions of said articles for protecting said end portions.

Still another object is to provide an end box for packaging articles that includes a one-piece blank that is formed with opposed face panels to which an intermediate one-piece end panel is joined, the one piece end panel being located at right angles with respect to the face panels when the blank is foldable to a position of use around the ends of the articles to be packaged.

Still another object is to provide an end box for packaging articles that includes face panels having slots formed therein that expose underlying surfaces of the articles therethrough, a flexible tie member being secured around the face panels and received in the slots for engaging the underlying surfaces of said articles, thereby mounting the end box on the end portions of said articles in secure relation.

Still another object is to provide an end box including opposed face panels to which side flaps are joined, the side flaps being foldable with respect to the face panels, slots being formed in the face panels and extending into the side flaps so that the articles to be packaged are exposed through the slots, and a strap being received in the slots and engaging the articles for firmly securing the end box on the articles adjacent to an end thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
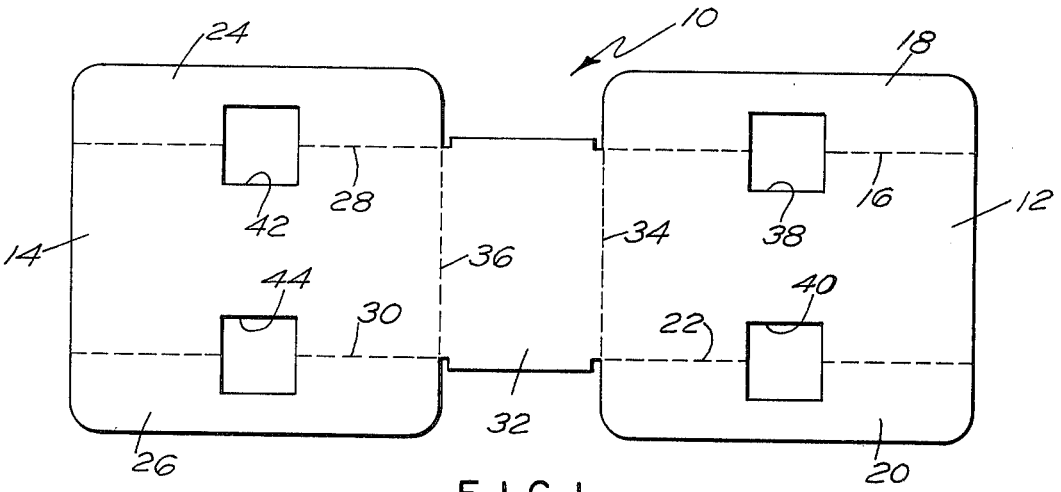
FIG. 1 is a top plan view of the blank of the end box as embodied in the present invention.

Referring now to the drawing and particularly to FIG. 1, a one-piece blank is illustrated that defines the end box embodied herein, the end box being generally indicated at 10. The one-piece blank which is die cut is preferably formed of cardboard or the like and in the folded position constitutes a container for receiving and packaging elongated articles therein. As will be described, the one-piece blank is foldable to a position of use around the end portions of the articles to be packaged, and in this position protects the end portions of the articles during shipping or storing. It is also contemplated that the blank be formed of a suitable plastic material and in this connection would include a plurality of hinge lines that would provide for folding of the box panels as described hereinbelow.

The one-piece blank includes opposed face panels 12 and 14 that are adapted to overlie the adjacent surfaces of the articles that are received in the end box. Joined to the face panel 12 and separated therefrom by a fold line 16 is a side flap 18, while an opposite side flap 20 is joined to the face panel 12 along a fold line 22. The face panel 14 has similar side flaps 24 and 26 joined thereto along fold lines 28 and 30, respectively. Integrally joined to the face panels 12 and 14 intermediate the inner ends thereof is an end panel 32, the end panel 32 being joined to the face panels 12 and 14, along fold lines 34 and 36, respectively.

Figure 3:
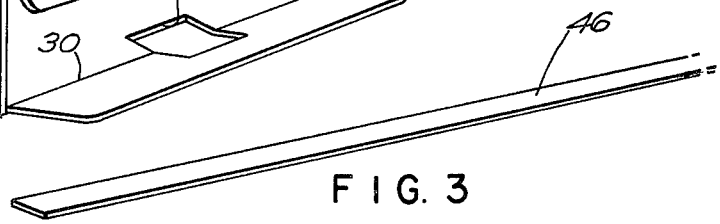
FIG. 3 is a perspective view of a strap that is utilized to secure the end box on the end portions of a plurality of articles.

Formed in the face panel 12 and extending into the side flaps 18 and 20 joined thereto, are slots 38 and 40, while similar slots 42 and 44 are formed in the face panel 14 and extend into the side flaps 24 and 26 joined thereto. As will be described, the slots 38, 40, 42 and 44 cooperate with a strap 46, illustrated in FIG. 3, to mount the end box 10 on the end portions of a plurality of articles.

Figure 4:
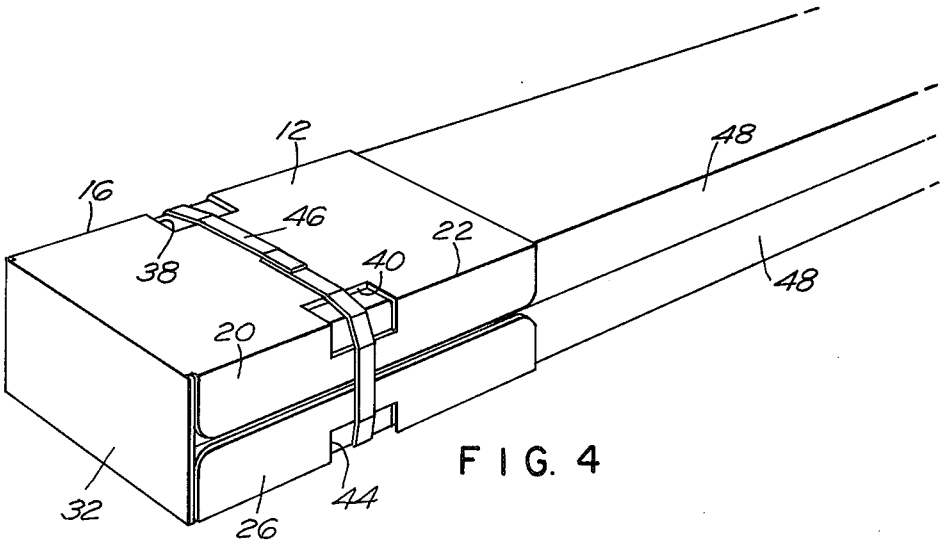
FIG. 4 is a perspective view showing the location of the end box as mounted on the end portions of a plurality of articles.

The purpose and function of the end box 10 is to package one or more articles therein, wherein the end box 10 is mounted only on an end portion of the articles. One example of articles to be packaged by the end box 10 is fluorescent fixtures which are normally packaged in pairs, and as illustrated in FIG. 4, each of the fixtures is indicated at 48. It is also contemplated to utilize the end box on a variety of articles, the shape of which may be rectangular, square or round. In the packaging of the fluorescent fixtures 48, the body portions thereof are normally located such that the open faces thereof that receive the fluorescent lamps therein are located in face-to-face relation, thereby protecting the interior body portions and the lamp mounting parts that are mounted thereon. Thus, the back of the fixtures 48 in the packaged position face outwardly, as illustrated in FIG. 4. Since storing or moving of the fluorescent fixtures is normally accomplished by locating them on pallets, it is desirable to stack the fixtures one on top of the other. It has been found that the fixtures can be safely packaged for storing in stacked relation by utilizing only an end box 10. As mounted on both ends of the fluorescent fixtures 48, the fixtures may be stacked one on top of the other, the thickness of the cardboard from which the end box is constructed amply protecting the intermediate surfaces of the fixtures.

It is understood that one or more of any kind of article may be packaged in the manner as illustrated and described, wherein only a portion of the article is covered by the boxes; and it is important in the packaging of articles such as fluorescent fixtures, that the outer ends thereof be protected during the shipping and storing, particularly since the ends are subject to the greatest wear and tear. It is for this reason that the end box 10 as embodied herein is uniquely suitable for packaging elongated articles such as fluorescent fixtures and for protecting the ends thereof during packaging and storing.

Figure 2:
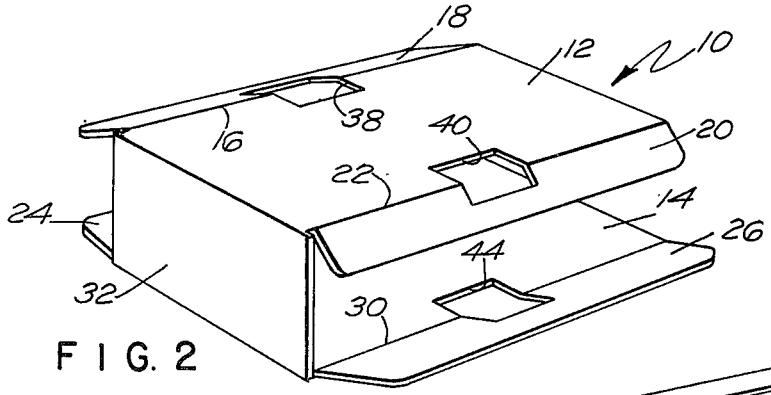
FIG. 2 is a perspective view of the end box as folded from the blank form and prior to the mounting thereof on the end portions of a plurality of articles.

In order to mount the end box 10 on a pluraltiy of articles such as the fluorescent fixtures 48, the face panels 12 and 14 are folded relative to the end panel 32 to that position illustrated in FIG. 2. The flaps 18, 20, 24, and 26 are also folded relative to their respective face panels; and with the end box 10 located substantially in the position as illustrated in FIG. 2, it is then securely fastened to the end portions of the fixtures 48, the end panel 32 in the position of use serving to cover the outer ends of the fixtures 48. With the end box 10 located on the outer portions of the fixtures 48, the strap 46 is wound transversely therearound and positioned within the slots 38, 40, 42 and 44. Since the slots expose the surfaces of the fixtures located thereunder, the strap as received within the slots engages these exposed surfaces and edges of the fixtures. The strap is preferably formed of a thermoplastic material that is responsive to heat for sealing the ends thereof together as illustrated in FIG. 4. However, it is understood that any form of flexible tie member could be utilized in place of the plastic strap, such as twine or cord, industrial fastening tape, metal strapping and the like. After the strap is wound around the face panels and side flaps of the box and positioned within the slots as formed in the face panels and flaps, proper tensioning is applied thereto, while at the same time the strap ends are heat sealed together as illustrated in FIG. 4. The strap 46 thereby locks the face panels and side flaps in place around the fixtures 48, the location of the strap within the slots 38, 40, 42 and 44 acting to prevent undue endwise movement of the strap, and thereby insuring the positive mounting of the end box 10 on the end portions of the fixtures 48.

It is seen that the end box 10 is simple in construction and may be rapidly and securely applied to the end portions of one or more articles. The end portions of the articles that are normally subjected to the most wear are amply protected by the end box 10, the one-piece end panel 32 insuring that the extreme ends of the articles are protected from the usual wear experienced in shipping and storing. The side flaps that are joined to the face panels 12 and 14 effectively cover the sides of the articles and are securely retained in place by the strap 46.

It is understood that an end box 10 is mounted on the articles, and with the articles so packaged with the ends thereof covered by the end boxes, the articles may be stacked in place one on top of the other without damage thereto. In this connection, the thickness of the face panels of the end boxes as received on the surfaces of said articles serve to space the intermediate portions of the stacked fixtures from each other, thereby protecting these surfaces from marring and scratching during shipping and/or storing of the articles. It is also feasible to mount the end box on the end of one or more articles that are relatively reduced in longitudinal dimension. In this event the intermediate portions of the articles would be completely covered by the end boxes mounted thereon.

Although not illustrated, it is contemplated that the slots as formed in the end box face panels and side flaps be eliminated. In such case, one of the side flaps of each pair would be somewhat longer than the adjacent flap and would be folded in overlapping relation with respect thereto. Instead of utilizing a flexible tie member for securing the flaps and panels in place, staples would be employed for securing the overlapping flaps together.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A blank for an end box in which elongated articles are packaged, comprising a one-piece construction defined by opposed panels between which a reduced panel is connected by score lines, each of said opposed panels including a central panel to which side flaps are joined along score lines and a plurality of substantially rectangular openings being formed in said opposed panels and bisecting said score lines dividing the central panels from the side flaps thereof, wherein said openings extend equally into said central panels and side flaps joined thereto.

* * * * *